US006030523A

United States Patent [19]

Varadaraj et al.

[11] Patent Number: 6,030,523

[45] Date of Patent: Feb. 29, 2000

[54] PROCESS FOR NEUTRALIZATION OF PETROLEUM ACIDS (LAW810)

[75] Inventors: Ramesh Varadaraj, Flemington; David William Savage, Lebanon, both of N.J.

[73] Assignee: Exxon Research and Engineering Co., Florham Park, N.J.

[21] Appl. No.: 09/258,619

[22] Filed: Feb. 26, 1999

Related U.S. Application Data

[63] Continuation-in-part of application No. 08/866,462, May 30, 1997, abandoned.

[51] Int. Cl.[7] ..... C10G 17/00

[52] U.S. Cl. ..... 208/263; 208/47; 208/348

[58] Field of Search ..... 208/263, 47, 348

[56] References Cited

U.S. PATENT DOCUMENTS

| | | | |
|---|---|---|---|
| 1,695,251 | 12/1928 | Kalichevsky . | |
| 2,028,335 | 1/1936 | Kalichevsky | 196/32 |
| 2,068,979 | 1/1937 | Fisher | 196/35 |
| 2,071,862 | 2/1937 | Fisher | 260/11 |
| 2,229,995 | 1/1941 | Yabroff et al. | 196/30 |
| 2,316,965 | 4/1943 | Mc Namara | 196/30 |
| 2,770,580 | 11/1956 | Honeycutt et al. | 196/36 |
| 2,789,081 | 4/1957 | Mills | 196/36 |
| 2,795,532 | 6/1957 | Honeycutt | 196/36 |
| 2,950,245 | 8/1960 | Thomsen | 208/348 |
| 3,806,437 | 4/1974 | Franse et al. | 204/190 |
| 3,847,774 | 11/1974 | Jarrell | 204/190 |
| 4,199,440 | 4/1980 | Verachtert | 208/230 |
| 4,300,995 | 11/1981 | Liotta | 208/8 LE |
| 5,182,013 | 1/1993 | Petersen | 208/348 |

FOREIGN PATENT DOCUMENTS

| | | | |
|---|---|---|---|
| WO 97/08270 | 3/1997 | WIPO | C10G 19/00 |
| WO 97/08271 | 3/1997 | WIPO | C10G 19/00 |
| WO 97/08275 | 3/1997 | WIPO | C10G 71/00 |

OTHER PUBLICATIONS

Petroleum Refining with Chemicals,V.Kalichevsky, 1956, pp. 137–173, Jan. 1956.

Kalichevsky et al, "Petroleum Refining With Chemicals", Elsevier Publishing Company (1956), Chapter 4, pp. 136–180.

Camp et al, "Neutralization as a Means of Controlling Corrosion of Refinery Equipment", Nat'l. Ass'n. of Corrosion Engineers, vol. 6, pp. 39–44.

Scattergood et al, "Naphthenic Acid Corrosion, An Update of Control Methods", Corrosion, Mar. 9–13, 1987, Paper Number 197, pp. 197–1 to 197–5.

*Primary Examiner*—Helane Myers
*Attorney, Agent, or Firm*—Linda M. Scuorzo

[57] ABSTRACT

The present invention describes a process for decreasing the acidity of a starting calcium containing, non-acid treated acidic crude oil by adding such an acidic crude oil to an effective amount of an aqueous base solution at conditions of pH and temperature sufficient to form an unstable emulsion of the acidic crude oil in the aqueous base solution; and breaking the emulsion to form a phase containing treated crude oil having a decreased acidity and aqueous phase residual containing base and neutralized acids. The invention has utility in crude oil processing.

9 Claims, 2 Drawing Sheets

PROCESS FOR NEUTRALIZATION OF PETROLEUM ACIDS (LAW810)

This application is a continuation-in-part of U.S. Ser. No. 08/866,462 filed May 30, 1997 now abandoned.

FIELD OF THE INVENTION

The present invention relates to a process for neutralizing petroleum acids.

BACKGROUND OF THE INVENTION

Whole crudes and crude fractions with high petroleum acid and calcium content are corrosive to the equipment used to extract, transport and process the crude. Additionally, calcium deposition on equipment used to process such crudes damages such equipment and interferes with subsequent processing steps.

Efforts to minimize naphthenic acid corrosion and calcium content in crudes and crude fractions have included a number of approaches. U.S. Pat. No. 5,182,013 refers to such recognized approaches as blending of higher naphthenic acid content oil with low naphthenic acid content oil. Additionally, a variety of attempts have been made to address the problem by using corrosion inhibitors for the metal surfaces of equipment exposed to the acids, or by neutralizing and removing the acids from the oil. For example, Kalichevsky and Kobe in *Petroleum Refining with Chemicals* (1956), Chapter 4 discloses various alkali treatments of crudes and crude fractions. U.S. Pat. No. 4,199,440 which teaches the use of difficult-to-break caustic-in-oil emulsions discloses treatment of a liquid hydrocarbon with a dilute aqueous alkaline solution, specifically dilute aqueous NaOH or KOH in conjunction with a filtration/coalescing bed. Dilute aqueous base was required in order to effect solubility of the naphthenic acids in the aqueous phase without encountering emulsion formation, which was disclosed to be undesirable. U.S. Pat. No. 4,300,995 discloses the treatment of carbonous material particularly coal and its products, heavy oils, vacuum gas oil, petroleum resids having acidic functionalities with a dilute quaternary base such as tetramethylammonium hydroxide in a liquid (alcohol or water) at a temperature of 100° C. to 300° C. IR data of the untreated crude show a peak at 3300–3600 $cm^{-1}$ corresponding to a phenolic hydroxide (Example 6). The $C^{13}$ NMR spectrum of o-methylated crude shows a signal at 55 ppm corresponding to a methyl phenoxide (Examples 3 and 4). This patent was aimed at improving yields and physical characteristics of the products by producing alkylated products of inter alia acidic functionalities and did not address the question of calcium reduction or neutralization of acidic functionalities. Kalichevsky and Kobe as well as U.S. Pat. No. 4,199,440 note, however, that a problem arises because certain aqueous base solutions form stable caustic-in-oil emulsions, necessitating use of only dilute aqueous base solutions. Additionally, these references typically treat crudes and crude fractions that previously have been acid pretreated (e.g., with $H_2SO_4$).

While these processes have achieved varying degrees of success, they do not address the dual treatment of acidic calcium containing crudes. Thus, there is a continuing need to develop more efficient methods for treating such calcium containing crudes.

SUMMARY OF THE INVENTION

The present invention provides for a process for decreasing the acidity and calcium content of an acidic calcium containing non-acid treated crude oil comprising: contacting an acidic, calcium containing, non-acid treated crude oil with an effective amount of an aqueous base solution at conditions of pH and temperature sufficient to form an unstable oil-in-water emulsion of the crude oil in the aqueous base and breaking the emulsion to form a phase containing treated crude oil having a decreased acidity and calcium content and aqueous phase containing residual base and neutralized acids.

The present invention may suitably comprise, consist or consist essentially of the elements disclosed and may be practiced in the absence of an element not disclosed.

DETAILED DESCRIPTION OF THE INVENTION

Figure 1:
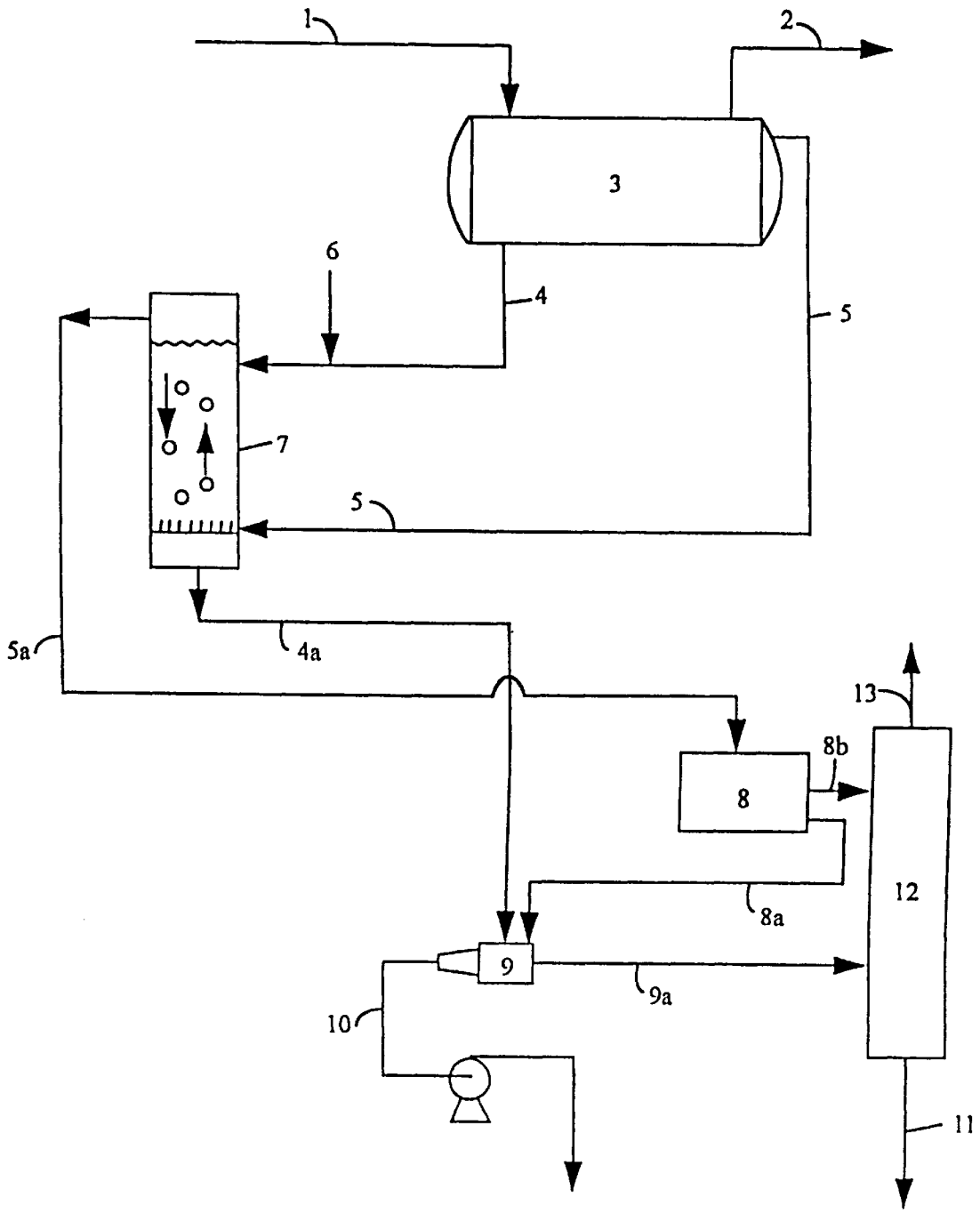
FIG. 1 describes the unstable oil in water emulsion treatment of the present invention as a standalone process.

Crudes that contain both organic acids and calcium present particular problems in refining. Organic acids contribute to corrosion and fouling of refinery equipment and are difficult to separate from the processed oil. The presence of calcium in acids contributes to the formation of naphthenic acid soaps which are similarly difficult to remove from processed crudes and which tend to accumulate as ash in process equipment to the detriment of subsequent processing steps. Organic acids generally fall within the category of naphthenic and other organic acids. Naphthenic acid is a generic term used to identify a mixture of organic acids present in petroleum stocks. Naphthenic acids may be present either alone or in combination with other organic acids, and/or phenols. Naphthenic acids alone or in combination with other organic acids can cause corrosion at temperatures ranging from about 65° C. (150° F.) to 420° C. (790° F.).

The crudes that may be used are any naphthenic acid and calcium-containing whole crude oils that are liquid or liquefiable at the temperatures at which the present invention is carried out. As used herein the term whole crudes means unrefined, non-distilled crudes. The crudes to be treated are preferably whole crudes. However, acidic calcium containing fractions of whole crudes such as vacuum gas oil also may be treated. Unlike certain prior art processes, applicants process does not acid treat the crudes before use. The present invention obviates the need for such pretreatment. An additional benefit of the treatment process is the absence or substantial absence of stable emulsions. Stable emulsions formation and entrainment of the treating agent in the oil is undesirable and a particular problem that is encountered during treatment of such crudes with aqueous bases. The formation of a stable water-in-crude oil emulsion tends to interfere with the efficient separation of the crude oil and aqueous phases and thus with recovery of the treated crude oil. Thus, in addition to their corrosivity such acids must be removed from the crude oil due to their tendency to encourage stable emulsion formation during processing, especially desalting processes. And, typically an additional separation step is required to remove the entrained minerals.

Although the prior art teaches away from the desirability of forming emulsions, (see, e.g., Kalichevsky and Kobe pages 139–141), Applicants have discovered that the formation of certain emulsions under certain conditions are desirable because they can be used to decrease acidity and calcium content without resulting in stable emulsions or entrainment.

Unexpectedly, and contrary to prior art teachings, Applicants have discovered that acidic crudes, (e.g., those containing naphthenic acids), and calcium containing acidic crudes may be treated to decrease both acidity and calcium content by mixing the crude with an effective amount of an aqueous base at conditions of pH and temperature sufficient to form an unstable emulsion of the crude oil in the aqueous base ("oil-in-aqueous base") and coalescing (destabilizing) the emulsion to produce a first phase containing a treated or final crude oil having a reduced or essential absence of acidity and calcium content and a second phase containing at least the remaining unreacted aqueous base. Neutralized acids, such as the corresponding naphthenate are present in the aqueous phase or at the interface between the first and second phases. Typically, the calcium is present as an insoluble, calcium-containing phase that is disposed between the first and second phases when the emulsion is broken.

Optionally, the aqueous phase containing excess base may be recovered and reused in either a batch or continuous process to contact additional untreated crude, typically until the pH of the recovered aqueous phase reaches a pH of 8.0. Thus, desirably the aqueous phase is not completely neutralized and excess base is present in the recovered aqueous base.

The aqueous base is suitably an aqueous Group IA or IIA hydroxide, preferably NaOH or KOH solution, more preferably NaOH, having a pH of at least 8, preferably 8 to 12.

An unstable emulsion is formed by adding the acidic and calcium containing crude oil with only mild agitation to the aqueous base in a sufficient ratio to produce a dispersion of oil in a continuous aqueous base phase. The crude oil should be added to the aqueous base rather than the aqueous base being added to the crude oil, in order to minimize formation of a stable aqueous base-in-oil emulsion. A ratio of at least 1:3, preferably 1:3 to 1:15, more preferably 1:3 to 1:4 of oil to aqueous base is used based on the weight of oil and water. A stable emulsion will form if the ratio of oil to aqueous base is 1:1 or less. The weight percent of base in water ranges from 0.5 to 3.0%. Density of the crude versus the aqueous phase can influence emulsion formation with a greater difference in density being preferred. Droplet size of from 10–50 microns preferably 20–50 microns is typically needed. Contacting of the crude oil and aqueous phase should be carried out for a period of time sufficient to disperse the oil in the aqueous phase preferably to cause at least 50% by weight, more preferably at least 80%, most preferably 90% of the oil in the aqueous phase.

Contacting is carried out until the pH of the basic aqueous phase decreases to about 8. Until such time the aqueous phase may be recycled for use to treat additional starting acidic crude oil.

The contacting of the crude oil and aqueous base solution to form the unstable emulsion is carried out at temperature typically from about 10° C. to 40° C. At temperatures of greater than 40° C. the probability of forming a stable emulsion increases.

Whole crudes contain naphthenic acids in the molar range of 150 to 800. Distillates are narrower cuts; most light distillates typically have less than 400 mol weight acids. Distillate fractions behave distinctly differently from crude fraction sin an unstable emulsion separation process. Distillates are normally free or essentially free of calcium as calcium tends to concentrate in bottoms. While crudes contain naphthenic acid salts of calcium magnesium and the like and, therefore, behave differently. Typically many distillates are also free or essentially free of magnesium. Because of the density and viscosity difference of the distillate versus aqueous phase in comparison to crudes versus aqueous phase the residence time for the hydrocarbon phase in the caustic phase will differ. Longer residence times are characteristic for crudes due to higher residence time and density. Enhanced process control provides longer residence time gives longer time of contact for the extraction/reaction of naphthenic acids at the crude oil/aqueous interface. Crudes have asphaltenes and other heavy end components that tend to form elastic films at the interface preventing rapid droplet-droplet coalescence. The result is relatively longer life for the droplet and better reaction efficiency, i.e., naphthenic acids form corresponding salts and extract out of the crude oil into the aqueous phase. In distillates this is almost completely absent and coalescences rates are higher.

Contacting times depend on the nature of the crude to be treated, its acid and calcium content, and the amount and type of aqueous base added, but typically may be carried out for from about 2 minutes to about 2 hours.

Additionally, there may be added to the basic aqueous phase prior to contacting with the starting crude oil a sufficient amount of non-ionic surfactant, preferably of a straight chain ethoxylated alcohol having a chain length of from 12 to 18 carbon atoms and from 10 to 50 ethoxy groups typically in an amount of less than 0.001 wt % based on weight of crude oil to enhance formation of the unstable emulsion.

Similarly, time needed to coalesce or destabilize the emulsion will vary but typically 1–2 minutes is a minimum. Oil type, particle size and distribution of oil droplets affects coalescence/destabilization rates. Gravity or an electrostatic field may be applied to facilitate demulsification. Destabilizing or demulsifying additives or agents are not required, but may be used to enhance the rate of emulsion breaking.

The emulsion may be broken by any suitable physical method, preferably by gravity coalescence to generate a treated crude having a reduced acidity and calcium content and an aqueous phase containing naphthenate salts. The calcium hydroxide and high molecular weight naphthenic acids may concentrate in a "middle phase" disposed between the aqueous and oil phases.

The bases and surfactants suitable for use in the process may be purchased commercially or synthesized using known procedures.

The concentration of acid in the crude oil is typically expressed as an acid neutralization number or acid number, which is the number of milligrams of KOH required to neutralize the acidity of one gram of oil. It may be determined according to ASTM D-664. Any acidic calcium containing crude may be treated according to the present invention, for example, crudes having an acid neutralization number of from 0.5 to 10 mg KOH/g acid. Typically, the decrease in acid content may be determined by a decrease in the neutralization number or in the intensity of the carboxyl band in the infrared spectrum at about 1708 $cm^{-1}$. Whole crude oils with acid numbers of about 1.0 and lower are considered to be of moderate to low corrosivity. Crudes with acid numbers greater than 1.5 are considered corrosive. Acidic crudes having free carboxyl groups may be effectively treated using the process of the present invention. Calcium content is determined by metals analysis ASTM #D4951 (ICP method) ASTM #D4927 (x-ray method).

Whole crude oils are very complex mixtures containing a wide range of contaminants and in which a large number of competing reactions may occur. Unexpectedly, in the current process not only is the acidity of the crude reduced but a reduction in calcium content is also effected.

The process of the present invention has utility in processes in which inhibiting or controlling liquid phase corrosion, e.g., of metal surfaces, is desired. More generally, the present invention may be used in applications in which a reduction in the acidity and calcium content of an acidic whole crude would be beneficial.

By way of example the process is especially beneficial for treatment to decrease acidity and calcium content of acidic, calcium containing crude oils at the wellhead. Such crudes typically contain impurities such as naturally occurring or coproduced water and gases. In FIG. 1 a full well stream containing whole acidic crude oil, water and gases is passed via line 1 to a separator 3, and separated into a gas stream, which is removed via line 2, a water stream containing trace amounts of oil which is removed via line 4 and combined with base, typically aqueous, from line 6 prior to entering contactor 7, and an oil stream containing trace amounts of water which is passed via line 5 to contactor 7. The upper water and base streams from lines 4 and 6 and lower oil stream from line 5 are contacted in contactor 7 to form an unstable oil in aqueous base emulsion. Treated oil containing residual water is drawn off overhead from contactor 7 via line 5*a* and passed to separator 8 to separate the treated oil from residual aqueous base. The lower phase of aqueous base containing residual treated oil is drawn off below via line 4*a* and passed to separator 9 from which aqueous base is recovered and passed out via line 10 and may be recycled to line 6 or disposed of, and residual treated oil is passed via line 9*a* to stabilizer tower 12. From separator 8 treated oil is removed via line 8*b* to stabilizer tower 12 while aqueous base is removed via line 8*a* to separator 9. From stabilizer tower 12 gases and volatiles are removed through line 13 and treated oil via line 11.

Figure 2:
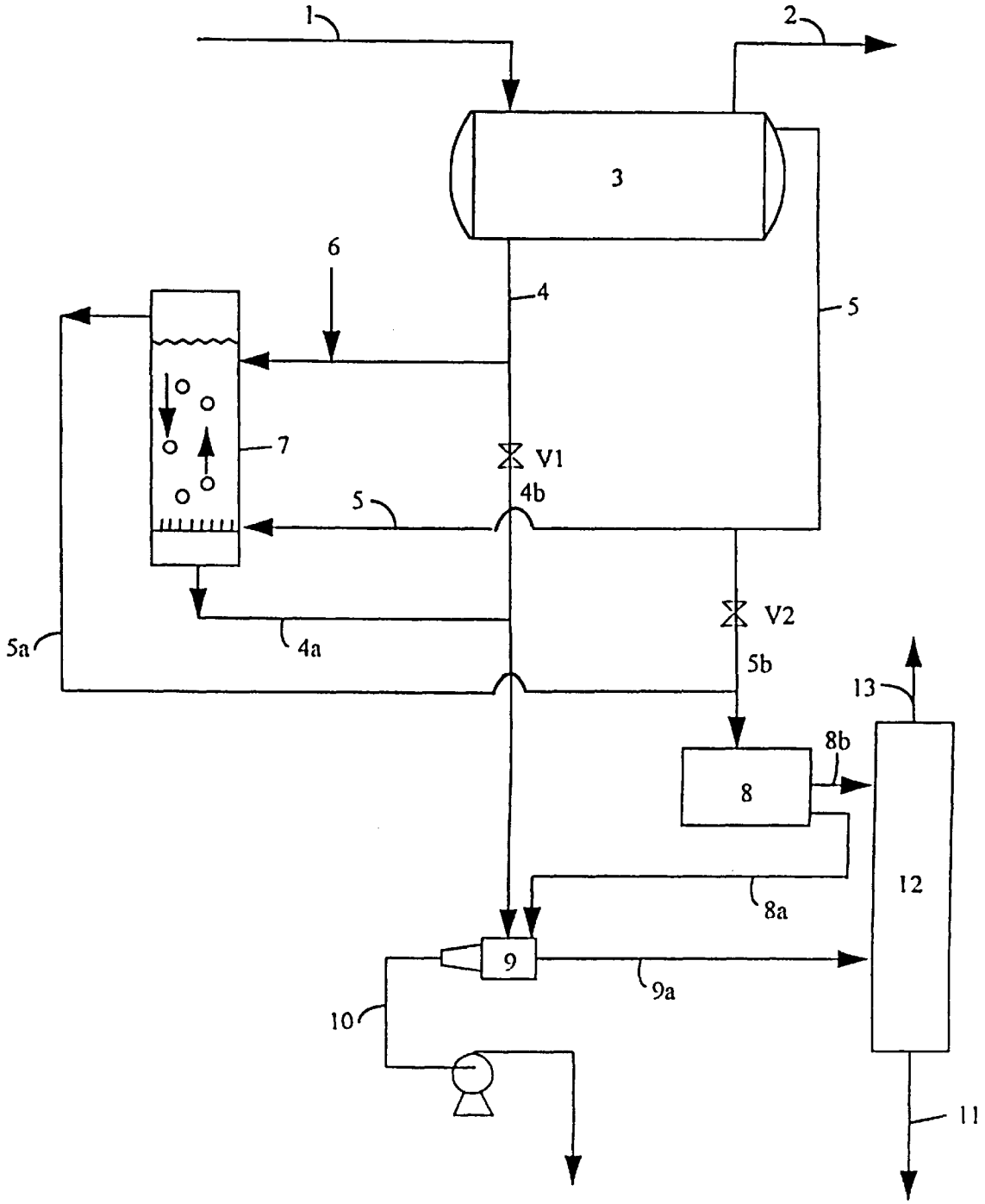
FIG. 2 describes the unstable oil in water emulsion treatment for removal of naphthenic acid from a crude oil at the well head integrated with a representative currently available process.

In FIG. 2 the process is shown integrated into a currently available process, thus 3, 8, 9 and 12 and the lines connecting them represent a process that exists typically at the wellhead for the separation of the full well stream line 1 into gas stream via line 2, treated oil stream via line 11, and aqueous base line 10. The streams leaving the separator 3 are gas via line 2, water containing traces of oil via line 4, and oil stream containing traces of water via line 5. The water containing trace amounts of oil passes via line 4 to a separator 9, which removes trace oil. The water is then injected into the well. The oil stream 5 passes to a separator 8, which removes traces of water. Finally the oil is passed via line 8*b* to a stabilizer tower 12 where residual gas and volatiles are removed overhead via line 13 and treated oil via line 11. The new contactor is represented by the block 7 and the lines connecting it to a typical current process. The feeds to contactor 7 are water via line 4 and the oil via line 5. Prior to entering contactor 7, base added via line 6 to the water line 4 as described with respect to FIG. 1 above. In contactor 7, the aqueous base from lines 4 and 6 and oil from line 5 are mixed so as to form the unstable oil-in-caustic emulsion as described with respect to FIG. 1, and after a sufficient mixing time, the phases are allowed to separate. The separated aqueous base-containing residual oil phase is passed via line 4*a* to separator 9, and the separated oil phase to separator 8. Valves V1 and V2 are provided to allow operation of the crude oil treatment process either in whole or in part with, or without the portions of the process associated with forming the unstable emulsion and separating the resulting products (contactor 7 and lines connected thereto) described in FIG. 1. The reference numerals in FIG. 2 correspond to the same numerals in FIG. 1.

The present invention may be demonstrated with reference to the following non-limiting examples.

EXAMPLE 1

25 g of Bolobo 2/4 (Chad crude oil) was added to 80 ml of 1.5 wt % NaOH solution in a separatory funnel. The oil/water mixture was shaken gently on a wrist shaker for 20 minutes. It was determined by droplet size measurements using a Coulter Multisizer 11 instrument that greater than 90% of the crude oil was dispersed as an oil-in-water emulsion. After contacting for 20 minutes, the shaker was stopped and the emulsion allowed to stand. In 10 minutes the emulsion destabilized and a yellowish lower aqueous phase separated out. The aqueous phase pH of 8.0 and the treated oil were separated. The aqueous phase was reused by repeating the above experiment (Example 2) with addition of a fresh batch of 20 g of Bolobo 2/4 crude. Two treated crude oil samples were generated from the experiment:

Sample #1 in which the acidic crude was treated with fresh aqueous NaOH.

Sample #P2 in which a second batch of acidic crude was treated with reused aqueous phase.

Both treated crude samples were centrifuged to remove traces of aqueous phase and then analyzed by the ASTM D-664 method. A 100% neutralization of the acid was observed. The corresponding aqueous phases from Samples #1 and #2 were neutralized with concentrated HCL to pH=3 and the petroleum acids were precipitated. The precipitated acids were extracted with methylene chloride and analyzed by infrared spectroscopy. A characteristic IR absorption at 1703 $cm^{-1}$ was observed confirming the extraction of naphthenic acid into the aqueous phase.

EXAMPLE 2

The procedure of Example 1 was repeated using ammonium hydroxide instead of sodium hydroxide. No reduction in acidity or extraction of acid into the aqueous phase was observed.

EXAMPLE 3

The procedure of Example 1 was repeated using tetrabutyl ammonium hydroxide instead of sodium hydroxide. A stable unbreakable emulsion resulted. The treated crude could not be separated from the aqueous phase.

EXAMPLE 4

A Chad crude (Kome 6/1) that was high in calcium (916 ppm) and in acidity was subjected to the procedure of Example 1. In addition to reduction in acidity, the calcium in the treated crude was reduced from 800 ppm to 32 ppm (96% reduction in calcium). A calcium-containing layer formed between the treated crude and aqueous phase when the unstable emulsion broke.

What is claimed is:

1. A process for decreasing the acidity and calcium content of an acidic, calcium-containing non-acid pretreated starting acidic crude oil, comprising:

(a) contacting an acidic, calcium containing non-acid pretreated crude with an effective wherein the ratio of starting acidic crude to aqueous base solution is amount of aqueous base at least 1:3 to 1:15 based on the weight of acidic crude to weight of aqueous base solution at conditions of pH and temperature sufficient to forming an unstable emulsion of the non-acid treated starting acidic, calcium containing crude oil in an aqueous base solution;

(b) breaking the unstable oil in aqueous base emulsion to produce a first phase containing treated crude oil having a decreased acidity and calcium content, a second aqueous phase containing residual base and neutralized acids, and a third intermediate phase containing an insoluble calcium containing compounds.

2. The process of claim 1 wherein the base is selected from the group consisting of NaOH and KOH.

3. The process of claim 1 wherein the base is present in an amount of from about 0.5 to 3 wt % in the aqueous base solution.

4. The process of claim 1 wherein the acidic crude oil in the aqueous emulsion has a droplet size of 10 to 50 microns.

5. The process of claim 1 wherein the insoluble calcium compound is calcium hydroxide.

6. The process of claim 1 wherein the solution further comprises a non-ionic ethoxylated alcohol surfactant having from 10 to 50 ethoxy groups and a chain length of 12 to 18 carbon atoms in as concentration in the aqueous phase of from 20–2000 ppm.

7. A process for decreasing the acidity and calcium content of an acidic, calcium containing, non-acid pretreated starting acidic crude oil, comprising:

(a) separating a starting whole acidic, calcium containing, non-acid pretreated starting crude oil feedstream into a first stream containing primarily water and trace amounts of the starting crude oil and a second stream containing primarily the starting crude oil and trace amounts of water;

(b) combining the first stream with aqueous base;

(c) countercurrently contacting the first and second stream to produce an unstable oil in aqueous base emulsion of from 1:3 to 1:5 ratio of crude:aqueous phase;

(d) recovering from step (c), a lower phase containing primarily aqueous base and residual treated oil and an upper phase containing primarily treated oil and residual aqueous base;

(e) separating the upper phase from step (d) into a treated oil stream containing residual water and an aqueous base stream containing residual treated oil;

(f) passing the lower phase of step (d) and the aqueous base stream of step (e) to a separator to recover an aqueous base stream and treated oil stream;

(g) passing the treated oil stream from step (e) and the treated oil stream from step (f) to a stabilizer tower;

(h) degassing and recovering the treated oil stream.

8. The process of claim 1 or 7 wherein the base is selected from the group consisting of NaOH and KOH.

9. The process of claim 1 or 7 wherein the aqueous base is present in an amount of from about 0.5 to 3 wt %.

* * * * *